US011297997B2

(12) United States Patent
Wong et al.

(10) Patent No.: US 11,297,997 B2
(45) Date of Patent: Apr. 12, 2022

(54) DISH WASHING MACHINE WITH HEAT EXCHANGERS

(71) Applicants: Kwok Din Wong, Hong Kong (CN); Li Zhou, Hong Kong (CN)

(72) Inventors: Kwok Din Wong, Hong Kong (CN); Li Zhou, Hong Kong (CN)

(73) Assignee: K.D.W. Company Limited, Hong Kong (CN)

( * ) Notice: Subject to any disclaimer, the term of this patent is extended or adjusted under 35 U.S.C. 154(b) by 746 days.

(21) Appl. No.: 15/945,279

(22) Filed: Apr. 4, 2018

(65) Prior Publication Data

US 2019/0307307 A1 Oct. 10, 2019

(51) Int. Cl.

| | |
|---|---|
| ***A47L 15/00*** | (2006.01) |
| ***A47L 15/22*** | (2006.01) |
| ***A47L 15/42*** | (2006.01) |

(52) U.S. Cl.

CPC ..... *A47L 15/0081* (2013.01); *A47L 15/22* (2013.01); *A47L 15/4287* (2013.01); *A47L 15/4291* (2013.01); *A47L 2501/03* (2013.01); *A47L 2501/06* (2013.01)

(58) Field of Classification Search

None

See application file for complete search history.

(56) References Cited

U.S. PATENT DOCUMENTS

| | | | |
|---|---|---|---|
| 5,331,986 A | 7/1994 | Lim et al. | |
| 5,453,131 A | 9/1995 | Chan et al. | |
| 5,660,193 A | 8/1997 | Archer et al. | |
| 8,679,261 B2 | 3/2014 | Brunswick et al. | |
| 9,078,555 B2 | 7/2015 | Heisele et al. | |
| 10,610,081 B2 | 4/2020 | Disch et al. | |
| 2010/0300499 A1 | 12/2010 | Han et al. | |
| 2012/0047961 A1* | 3/2012 | Tarr | F28F 9/0253 68/13 R |
| 2013/0152981 A1 | 6/2013 | Bertsch et al. | |
| 2014/0338754 A1 | 11/2014 | Nuti | |

(Continued)

FOREIGN PATENT DOCUMENTS

| | | |
|---|---|---|
| CN | 1083692 A | 3/1994 |
| CN | 1220129 A | 6/1999 |

(Continued)

OTHER PUBLICATIONS

International Search Report issued in Application No. PCT/CN2018/109245 dated Jan. 9, 2019 (5 pages).

(Continued)

*Primary Examiner* — Levon J Shahinian

(74) *Attorney, Agent, or Firm* — Flynn Thiel, P.C.

(57) ABSTRACT

A dish washing machine including a housing having an interior wash space for washing dishes. The housing has a liquid inlet for adding a liquid to the dish washing machine. At least one spray nozzle sprays the liquid onto dishes positioned within the interior wash space. The machine further includes a heating tank for heating the liquid which is supplied to the at least one spray nozzle for spraying onto the dishes in the interior wash space. At least one heat exchange system is within the housing. The at least one heat exchange system transfers heat from the liquid heated by the heating tank to the liquid added to the dish washing machine from the liquid inlet.

19 Claims, 12 Drawing Sheets

(56) References Cited

U.S. PATENT DOCUMENTS

| | | | | |
|---|---|---|---|---|
| 2016/0324390 | A1* | 11/2016 | Toga | A47L 15/4291 |
| 2018/0256001 | A1 | 9/2018 | Wong et al. | |

FOREIGN PATENT DOCUMENTS

| | | | |
|---|---|---|---|
| CN | 101229046 | A | 7/2008 |
| CN | 101862171 | A | 10/2010 |
| CN | 101961237 | A | 2/2011 |
| CN | 102458210 | A | 5/2012 |
| CN | 103519764 | A | 1/2014 |
| CN | 203524618 | U | 4/2014 |
| CN | 104939781 | A | 9/2015 |
| CN | 105615809 | A | 6/2016 |
| DE | 102013213970 | A1 | 2/2015 |
| DE | 102014217503 | A1 | 3/2016 |
| EP | 0689791 | A1 | 1/1996 |
| EP | 2292136 | A1 | 3/2011 |
| JP | 10-75926 | A | 3/1998 |
| JP | 2001-292944 | A | 10/2001 |
| JP | 2007-7178 | A | 1/2007 |
| JP | 2009-89941 | A | 4/2009 |
| JP | 2009-131512 | A | 6/2009 |
| TW | I441610 | B | 6/2014 |

OTHER PUBLICATIONS

Written Opinion issued in Application No. PCT/CN2018/109245 dated Jan. 9, 2019 (6 pages).

Written Opinion of the International Searching Authority and International Search Report issued in PCT/CN2017/083098 dated Dec. 14, 2017 (12 pages).

Taiwan Office Action issued in corresponding Taiwan Patent Application No. 108124847, with English translation of search report, dated Aug. 18, 2020 (7 pages).

European Search Report issued by the European Patent Office in corresponding European Application No. 18913495.0, dated Dec. 2, 2021 (16 pages).

* cited by examiner

DISH WASHING MACHINE WITH HEAT EXCHANGERS

FIELD OF THE INVENTION

This disclosure relates generally to the field of dish washing machines, and in particular to dish washing machines with heat exchangers.

BACKGROUND OF THE INVENTION

Commercial establishments for cooking and/or preparing food typically have a commercial dish washer for washing dirty dishes. The dish washers spray a detergent and water onto the dirty dishes to clean the dishes. The dish washers can also spray a rinse detergent and water onto the dishes after the dishes have been washed to rinse the dishes and prevent spots on the dishes.

Currently, there are four main types of commercial dish washers in worldwide markets. The commercial dish washers include an under-counter dish washing machine, a hood or door type dish washing machine, a tunnel type dish washing machine and a flight type dish washing machine. The under-counter dish washing machine has a small size and low profile and is positioned under a separate work bench with a wash basin next to the space occupied by the under-counter dish washing machine. The hood or door type dish washing machine, the tunnel type dish washing machine and the flight type dish washing machine all have a medium to large size and are positioned next to a separate side bench with a wash basin on the bench. The under-counter dish washing machine, the hood or door type dish washing machine and the tunnel type dish washing machine all typically use a rack or container having the dirty dishes that is positioned within the machine. The flight type dish washing machine has dishes that are put directly onto an integral conveyor and washed as the dishes pass therethrough.

A more efficient and environmentally friendly commercial dish washer is desired.

SUMMARY OF THE INVENTION

The present invention, according to one aspect, is directed to a dish washing machine including a housing having an interior wash space for washing dishes. The housing has a liquid inlet for adding a liquid to the dish washing machine. At least one spray nozzle sprays the liquid onto dishes positioned within the interior wash space. The machine further includes a heating tank for heating the liquid which is supplied to the at least one spray nozzle for spraying onto the dishes in the interior wash space. At least one heat exchange system is within the housing. The at least one heat exchange system transfers heat from the liquid heated by the heating tank to the liquid added to the dish washing machine from the liquid inlet.

Yet another aspect of the present invention is to provide a dish washing machine comprising a housing having an interior wash space for washing dishes, the interior wash space being encompassed by at least one wall, the housing having a liquid inlet for adding a liquid to the dish washing machine; at least one rotating spray nozzle for spraying the liquid onto dishes positioned within the interior wash space; a heating tank for heating the liquid which is supplied to the at least one spray nozzle for spraying onto the dishes in the interior wash space; at least two heat exchange systems within the housing including at least a first heat exchange system and a second heat exchange system, the at least two heat exchange systems transferring heat from the liquid heated by the heating tank to the liquid added to the dish washing machine from the liquid inlet; the liquid entering the dish washing machine passes sequentially from the liquid inlet, then to the first heat exchange system, then to the second heat exchange system and then to the heating tank; the first heat exchange system comprises a pipe having a first path therethrough and a second path therethrough; the first path is located between the liquid inlet and the second heat exchange system; the second path is located between a drain for the interior wash space and a liquid outlet of the housing; the second heat exchanger includes a fluid path through the at least one wall; and the liquid in the fluid path of the second heat exchanger exchanges heat with the liquid sprayed from the at least one spray nozzle.

BRIEF DESCRIPTION OF THE DRAWINGS

One or more embodiments of the present invention are illustrated by way of example and should not be construed as being limited to the specific embodiments depicted in the accompanying drawings, in which like reference numerals indicate similar elements.

Figure 1:
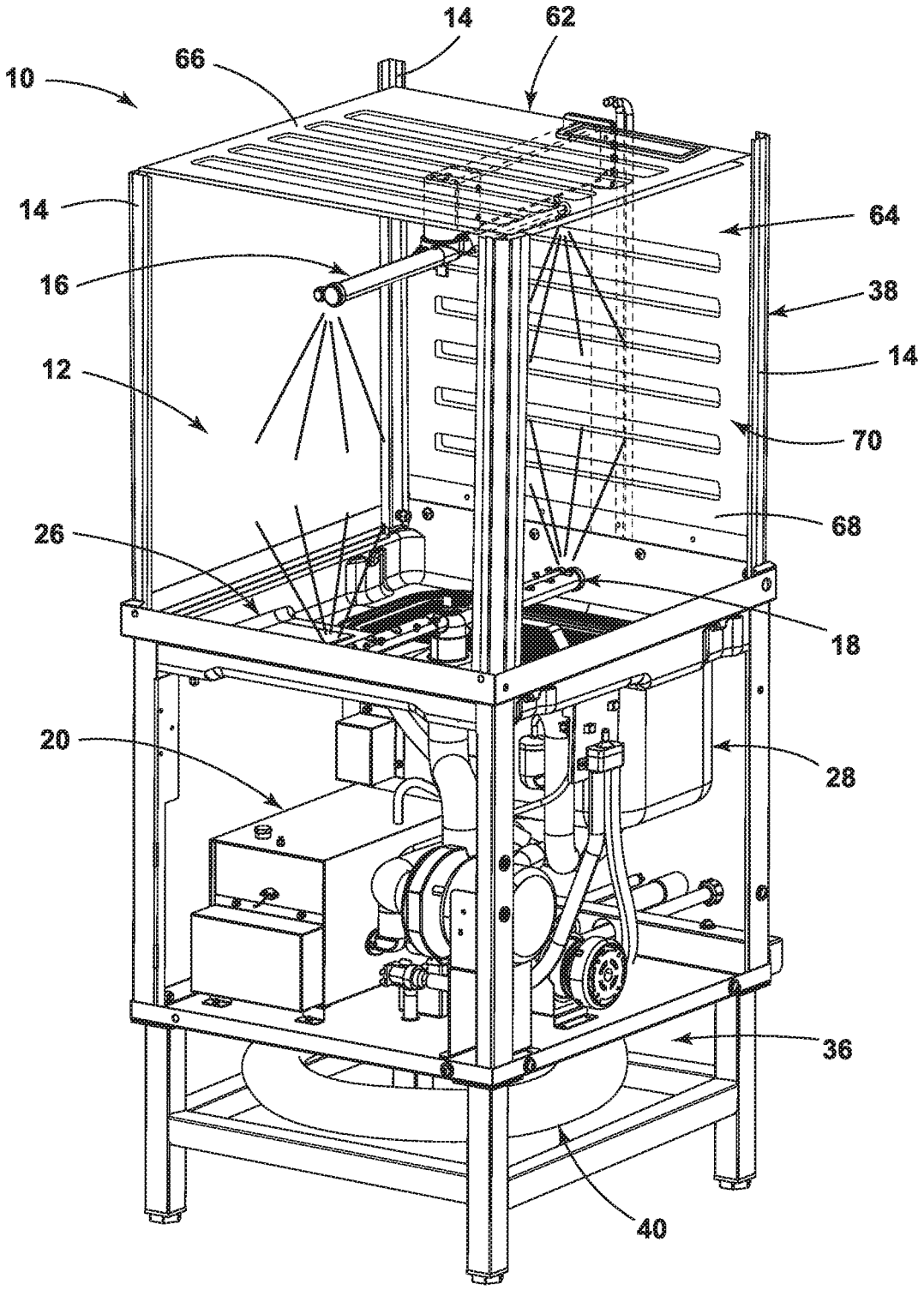
FIG. 1 is a front perspective view of a dish washing machine according to an embodiment with walls and a door removed for reference.

Certain terminology will be used in the following description for convenience in reference only and will not be limiting. Said terminology will include the words specifically mentioned, derivatives thereof, and words of similar import.

DETAILED DESCRIPTION

Reference will now be made in detail to implementations and embodiments of various aspects and variations of the invention, examples of which are illustrated in the accompanying drawings. Although at least two variations of the systems, methods and uses are described, other variations of the systems, methods and uses may include aspects of the systems, methods and uses described herein combined in any suitable manner having combinations of all or some of the aspects described.

FIGS. 1-6 illustrate an embodiment of a dish washing machine 10. The dish washing machine 10 includes an interior wash space 12 for accepting dishes (e.g., glasses, plates, eating and serving utensils, etc.) for cleaning the dishes. While not shown, the interior wash space 12 can include at least one shelf or ledge as is known to those skilled in the art for directly holding the dishes or holding a tray or rack holding the dishes. In FIGS. 1-6, exterior walls of the dish washing machine 10 are not shown in order to be able to view the interior of the dish washing machine 10. It is contemplated that the dish washing machine 10 can include at least one door for selectively accessing the interior wash space 12 of the dish washing machine 10 and enclosing the interior wash space 12 of the dish washing machine 10 during use. For example, a door can be connected to a wall to selectively open the dish washing machine 10 (e.g., a rotatable door) or wall(s) (not shown) can be slid upward along posts 14 of the dish washing machine 10 to allow access to the interior wash space 12 of the dish washing machine 10 and slid back down into position to enclose the interior wash space 12 of the dish washing machine 10 during use.

In the illustrated example, the interior wash space 12 of the dish washing machine 10 includes a top rotating spray arm 16 located at a top of the interior wash space 12 for positioning above the dishes (and possibly the tray or rack) along with a bottom rotating spray arm 18 located at a bottom of the interior wash space 12 and below the dishes (and possibly the tray or rack) for spraying water, a washing fluid and/or a rinsing fluid onto the dishes to clean the dishes. Water in a booster heating tank 20 is supplied to the top rotating spray arm 16 and the bottom rotating spray arm 18 to wash and rinse the dishes.

Systems for supplying the water to the interior wash space 12 of the dish washing machine 10 via the top rotating spray arm 16 and the bottom rotating spray arm 18 are well known to those skilled in the art and any such system can be used. For example, the system for supplying water to the interior wash space 12 of the dish washing machine 10 via the top rotating spray arm 16 and the bottom rotating spray arm 18 as set forth in U.S. patent application Ser. No. 15/455,536 entitled DISH WASHING MACHINE, the entire contents of which are hereby incorporated herein by reference, could be used. Alternatives could also be used. For example, the system could use only one of the top rotating spray arm 16 or the bottom rotating spray arm 18, the arms could be stationary and/or could employ other nozzle (e.g., stationary nozzles extending from interior walls) for spraying water onto the dishes for cleaning the dishes.

In the illustrated embodiment, the system works by first pre-heating the water supplied to the booster heating tank 20. The water is pre-heated using heat exchange system as outlined below. After heated to a desired temperature in the booster heating tank 20, the water is sucked by a pump from the booster heating tank 20 into a line with a splitter or a pair of lines to bring the water to an upper line 30 that leads to the top rotating spray arm 16 and a lower line 32 that leads to the bottom rotating spray arm 18. The upper line 30 and the lower line 32 can both have a one-way valve on an end thereof to prevent water from returning thereto. The heated water from the upper line 30 and the lower line 32 spray through nozzles in the top rotating spray arm 16 and the bottom rotating spray arm 18, respectively. After leaving the top rotating spray arm 16 and the bottom rotating spray arm 18, the heated water falls to a bottom basin 26 and flows through a bottom hole therein into a wash tank 28.

In the illustrated example, once enough water pools into the wash tank 28, the wash process is ready to begin. A wash detergent can be injected into the wash tank 28 to help with the cleaning of the dishes and the water in the wash tank is heated (e.g., to about 65° C. or higher). When the wash process is ready to begin, the supply of water from the booster heating tank 20 to the wash tank 28 via the spray arms 16, 18 is stopped. It is contemplated that wash detergent could be added to the wash tank 28 periodically or continually during the wash process. After the wash detergent is added to the water in the wash tank 28, a wash pump forces the water in the wash tank 28 into an upper wash line 22 and a lower wash line 24. The upper wash line 22 leads to a wash path in the top rotating spray arm 16 and the lower wash line 24 leads to a wash path in the bottom rotating spray arm 18. The upper wash line 22 and the lower wash line 24 can both have a one-way valve on an end thereof to prevent water from returning thereto. The wash water from the upper wash line 22 and the lower wash line 24 spray through wash nozzles in the top rotating spray arm 16 and the bottom rotating spray arm 18, respectively. The force of the wash water leaving the wash nozzles forces the top rotating spray arm 16 (spraying downward) and the bottom rotating spray arm 18 (spraying upward) to rotate as is well known to those skilled in the art. Eventually, the wash water falls to the bottom basin 26 and flows through the bottom hole therein into the wash tank 28, wherein the process of pumping the wash water to the top rotating spray arm 16 and the bottom rotating spray arm 18 continuously occurs during the washing cycle. After the illustrated washing cycle is complete, the wash water is removed from the dish washing machine 10 through a drain pipe 34 by force of a discharge pump and/or gravity.

In the illustrated example, after the dishes in the dish washing machine 10 have been washed, the dishes are rinsed. During the rinsing cycle, more pre-heated water is supplied to the booster heating tank 20. Once in the booster heating tank 20, the water is heated to assist in rinsing the dishes. It is contemplated that the booster heating tank 20 can heat the water to about 85° C. or higher. It is contemplated that the system for washing dishes could measure the temperature of the water in the booster heating tank 20 before proceeding or the water could be heated in the booster heating tank 20 for a certain period of time before proceeding. During, before or after the water is heated in the booster heating tank 20, a rinse wash detergent is injected into the booster heating tank 20 to help with the rinsing of the dishes. After the rinse water is heated and the rinse detergent is added thereto, the rinse pump sucks the rinse water from the booster heating tank 20 and cycles the rinse water several times through the system in the same manner as the wash water passing through the system. Even though the pumping of the wash water and the rinse water from the wash tank 28 is described as happening in two steps (i.e., the washer water and then the rinse water is pumped from the wash tank 28), it is contemplated that the rinsing of the dishes can take place directly after the washing cycle such that a mixture of the wash water and the rinse water is pumped from the wash tank 28 to the outlet. Furthermore, it is contemplated that not all wash water and rinse water are drained away from the wash tank 28 after each wash cycle.

Aspects of the present embodiment include a method of pre-heating water from a source of water before the water enters the booster heating tank 20. FIGS. 1-6 illustrate a system with a first heat exchange system 36 and a second heat exchange system 38, although it is contemplated that only one of the first heat exchange system 36 or the second heat exchange system 38 could be used. Moreover, while the water is shown as being pre-heated by travelling from the first heat exchange system 36 to the second heat exchange system 38, the path could be reversed with the water traveling first to the second heat exchange system 38 and then to the first heat exchange system 36.

Figure 3:
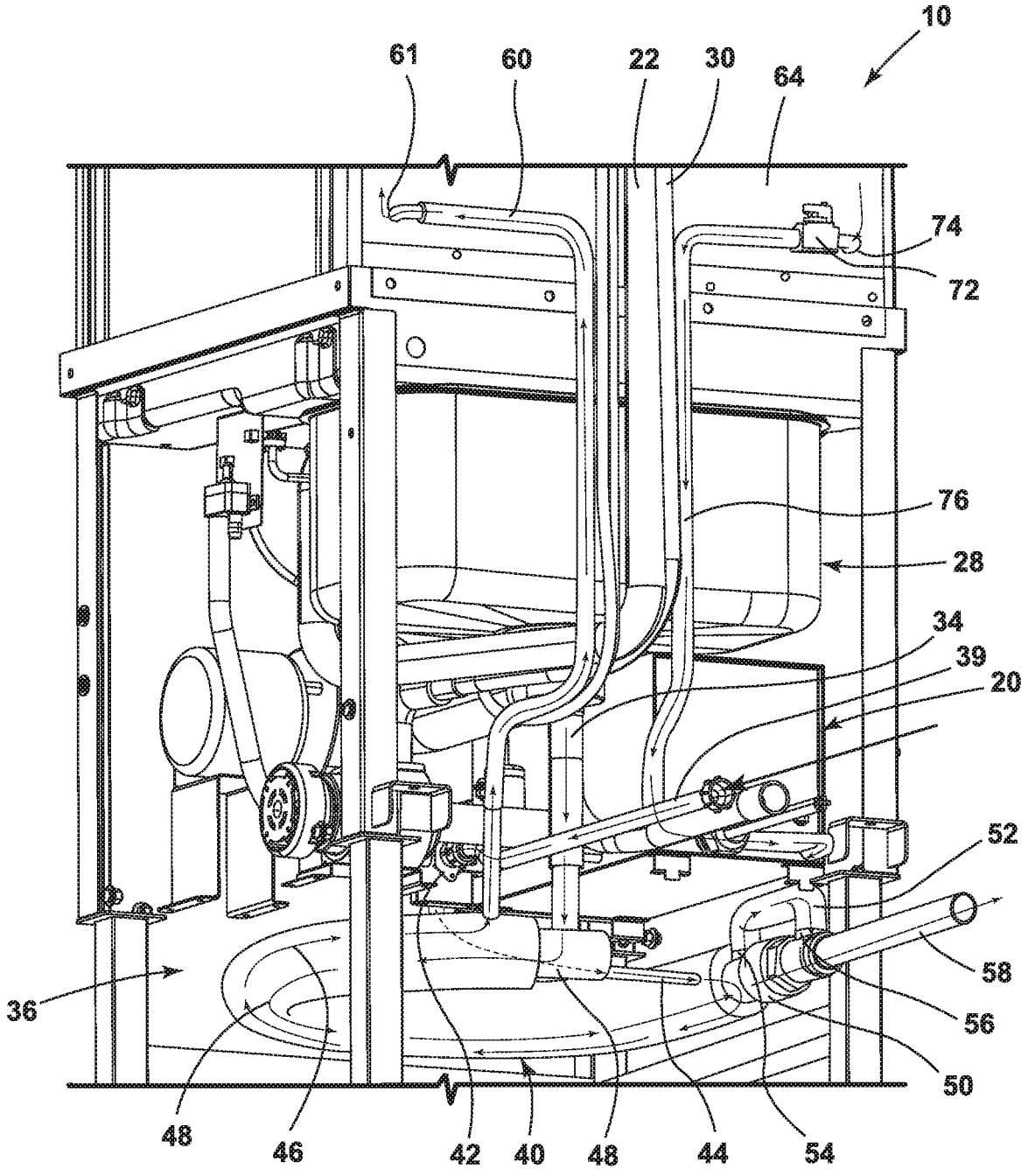
FIG. 3 is a close-up partial rear perspective view of the dish washing machine according to an embodiment illustrating flow of heat exchanged fluid.
Figure 4:
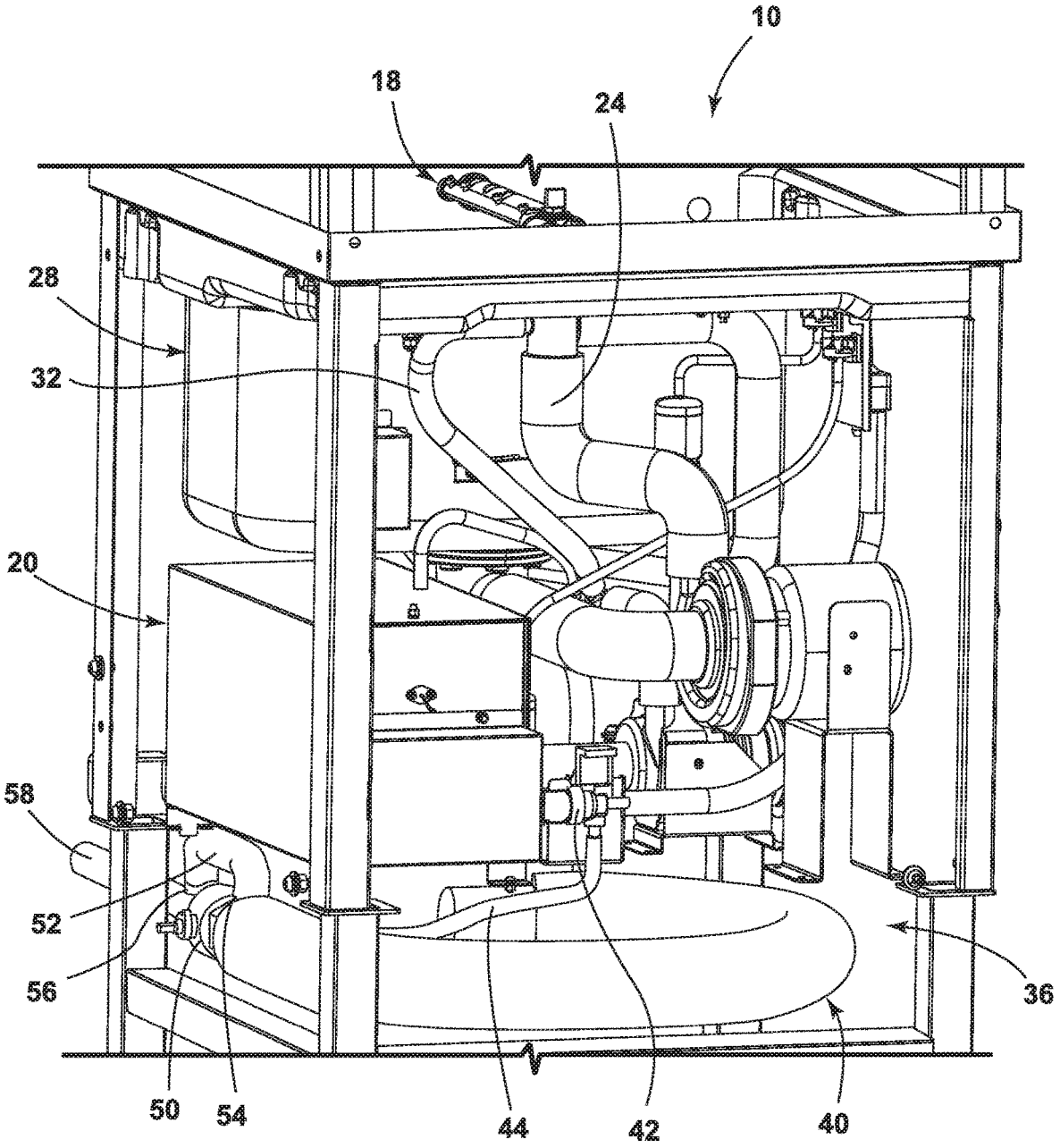
FIG. 4 is a close-up partial front perspective view of the dish washing machine according to an embodiment illustrating flow of heat exchanged fluid.

In the illustrated example, the first heat exchange system 36 uses waste water from the wash tank 28 to heat the water entering the booster heating tank 20. As illustrated in FIG. 3, water enters the dish washing machine 10 through an inlet pipe 39. The inlet pipe 39 ends at an input valve 42 that is selectively actuated to allow water to enter the dish washing machine 10. Once the input valve 42 is opened, water passes through an entrance pipe 44 into the first heat exchange system 36. The first heat exchange system 36 includes a heat exchange pipe 40 that has the water from the entrance pipe 44 flowing therethrough.

In the illustrated embodiment, hot waste water also flows through the heat exchange pipe 40 to transfer heat from the hot waste water to the input water. In the illustrated example, the heat exchange pipe 40 includes an outer tube 46 having the water from the entrance pipe 44 flow therethrough. The outer tube 46 surrounds a hot water exit tube 48 that has hot waste water flowing in a direction opposite to the outer tube 46. As outlined above, after the washing cycle and the rinsing cycle, the drain pipe 34, which is connected to the wash tank 28, selectively allows the hot waste water to empty from the wash tank 28. The drain pipe 34 is connected to the hot water exit tube 48 such that the hot waste water transfers heat to the input water as the waste wash and rinse water pass through the hot water exit tube 48. While a co-axial design of the heat exchange pipe 40 is illustrated, it is contemplated that any boundary wall could be used in the heat exchange pipe 40 and the input water and the hot waste water could exchange heat in any manner in the heat exchange pipe 40. Moreover, the heat exchange pipe 40 could have any cross-sectional shape (e.g., circular, U-shaped, rectangular or any other shape) and the length of the heat exchange pipe 40 could be any length (and that preferably resides within the same footprint as the housing of the dish washing machine 10).

The illustrated first heat exchange system 36 can allow the input water and/or the waste water to be held within the heat exchange pipe 40 or selectively flow through the heat exchange pipe 40. A flow control device 50 is located at an end of the heat exchange pipe 40 to control flow of the waste water through the heat exchange pipe 40. The flow control device 50 can hold the waste water within the heat exchange pipe 40 or let the waste water pass through one or multiple internal sections of the heat exchange pipe 40.

In the illustrated example, a bypass pipe 52 can be located adjacent the flow control device 50 and have an input side 54 before the flow control device 50 and an output side 56 after the flow control device 50. The bypass pipe 52 is located above the flow control device 50 to allow excess waste water to flow through the bypass pipe 52 to an exit tube 58 that allows the waste water to exit the dish washing machine 10. Waste water can only enter and pass through the bypass pipe 52 when pressure from the water entering the heat exchange pipe 40 is strong enough to overcome the force of gravity to rise up through the input side 54 of the bypass pipe 52. However, since the heat exchange pipe 40 is on the same level as the flow control device 50, the flow control device 50 can close to keep waste water within the heat exchange pipe 40. In one embodiment, gravity can push the waste water up through the input side 54 of the bypass pipe 52 because the wash tank 28 is higher than the bypass pipe 52. The system will level out when the waste water in the drain pipe 34 is at the same level as the bypass pipe 52. At that point, the system will be at equilibrium with waste water still in the heat exchange pipe 40. At the equilibrium state, the waste water will only drain from the heat exchange pipe 40 when the flow control device 50 opens to allow the waste water to exit to the exit tube 58. The bypass pipe 52 allows for subsequent waste water to flow past the flow control device 50 while a portion of the hot waste water is held inside the heat exchange pipe 40. The flow control device 50 (and gravity) can be used to hold the hot waste water within the heat exchange pipe 40 to therefore allow the hot waste water longer contact time with the input water for greater heat exchange. The flow control device 50 can be opened to drain away all waste water in the heat exchange pipe 40 at the end of a day.

In the illustrated example, the input water can also pass through the second heat exchange system 38 to increase the temperature of the input water before the water enters the booster heating tank 20. As shown in FIG. 3, a first transfer pipe 60 extends between the first heat exchange system 36 and the second heat exchange system 38. The first transfer pipe 60 takes the water from the outer tube 46 of the heat exchange pipe 40 to an entrance 61 of the second heat exchange system 38. The first transfer pipe 60 extends in at least a portion adjacent a rear side of the housing of the dish washing machine 10.

The illustrated second heat exchange system 38 includes at least one wall 62 adjacent the interior wash space 12 of the dish washing machine 10 that has the water from the first transfer pipe 60 passing therethrough. In the illustrated embodiment, the at least one wall 62 comprising the second heat exchange system 38 includes a rear wall 64 and a top wall 66. Each of the rear wall 64 and the top wall 66 include a plurality of cells or compartments 68 for holding water. As the wash water or rinse water is spraying within the interior wash space 12 of the dish washing machine 10 from the top rotating spray arm 16 and the bottom rotating spray arm 18, the hot wash water or rinse water will spray against or splash against an interior side 70 of the rear wall 64 and the top wall 66, thereby heating the interior side 70 of the rear wall 64 and the top wall 66. The hot interior side 70 of the rear wall 64 and the top wall 66 will then heat the water within the cells or compartments 68 of the rear wall 64 and the top wall 66. Moreover, hot air and/or mist inside the interior wash space 12 of the dish washing machine 10 will also transfer heat to the interior side 70 of the rear wall 64 and the top wall 66 and thereby the water within the cells or compartments 68 of the rear wall 64 and the top wall 66. It is contemplated that the at least one wall 62 can be made from one or multiple sheets of metal formed and/or welded together to form the cells or compartments 68 and a boundary wall of the at least one wall 62 to keep the water within the at least one wall 62. The second heat exchange system 38 can be an integral part of the dish washing machine 10 or can be attached (permanently or removably) to the inside of the dish washing machine 10. The second heat exchange system 38 also helps to reduce the exterior temperature of the dish washing machine as the walls 62 of the dish washing machine have a reduced temperature because of the transfer of the heat to the water therein.

Figure 2:
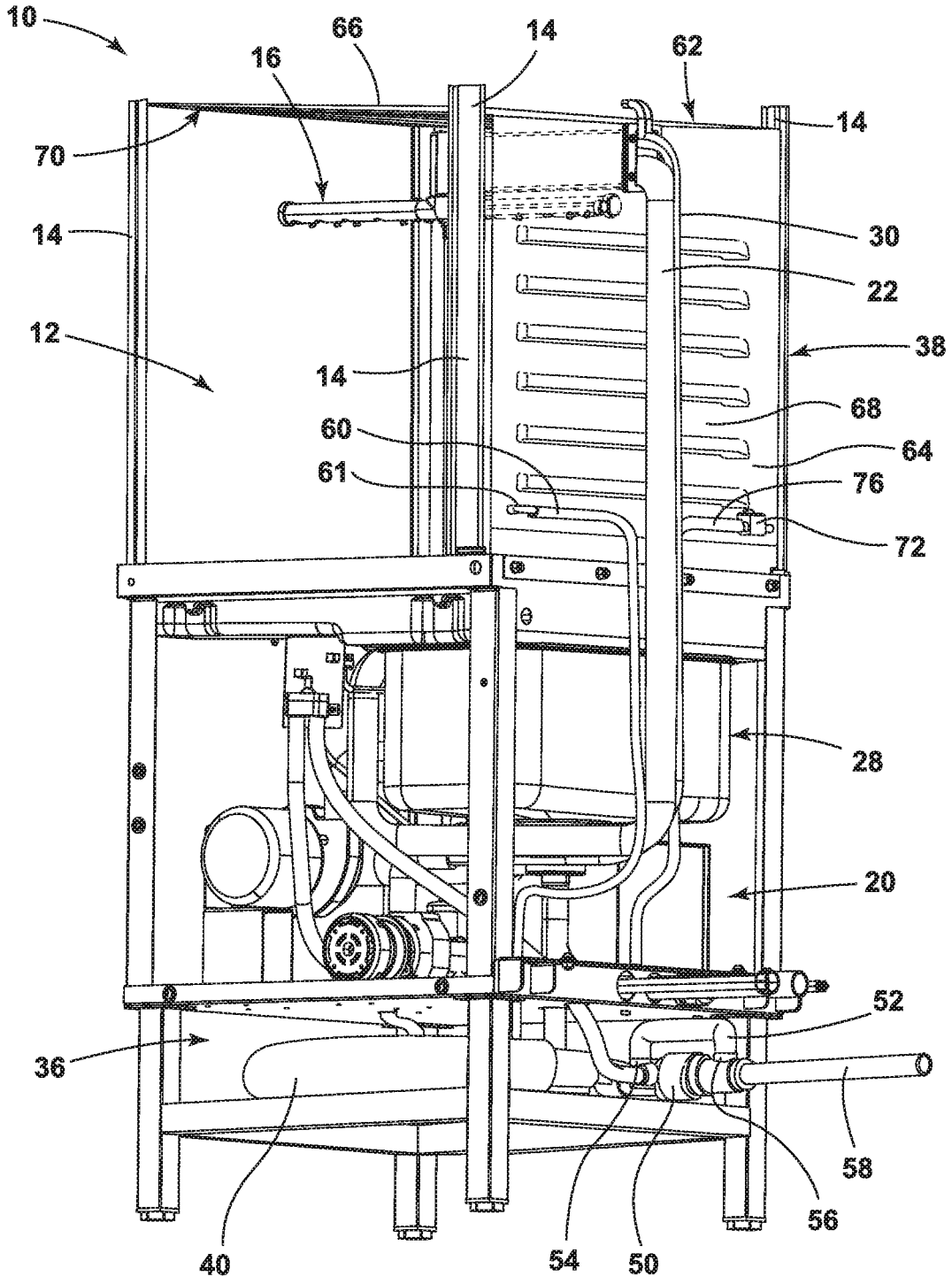
FIG. 2 is a rear perspective view of the dish washing machine according to an embodiment with walls and a door removed for reference.
Figure 5:
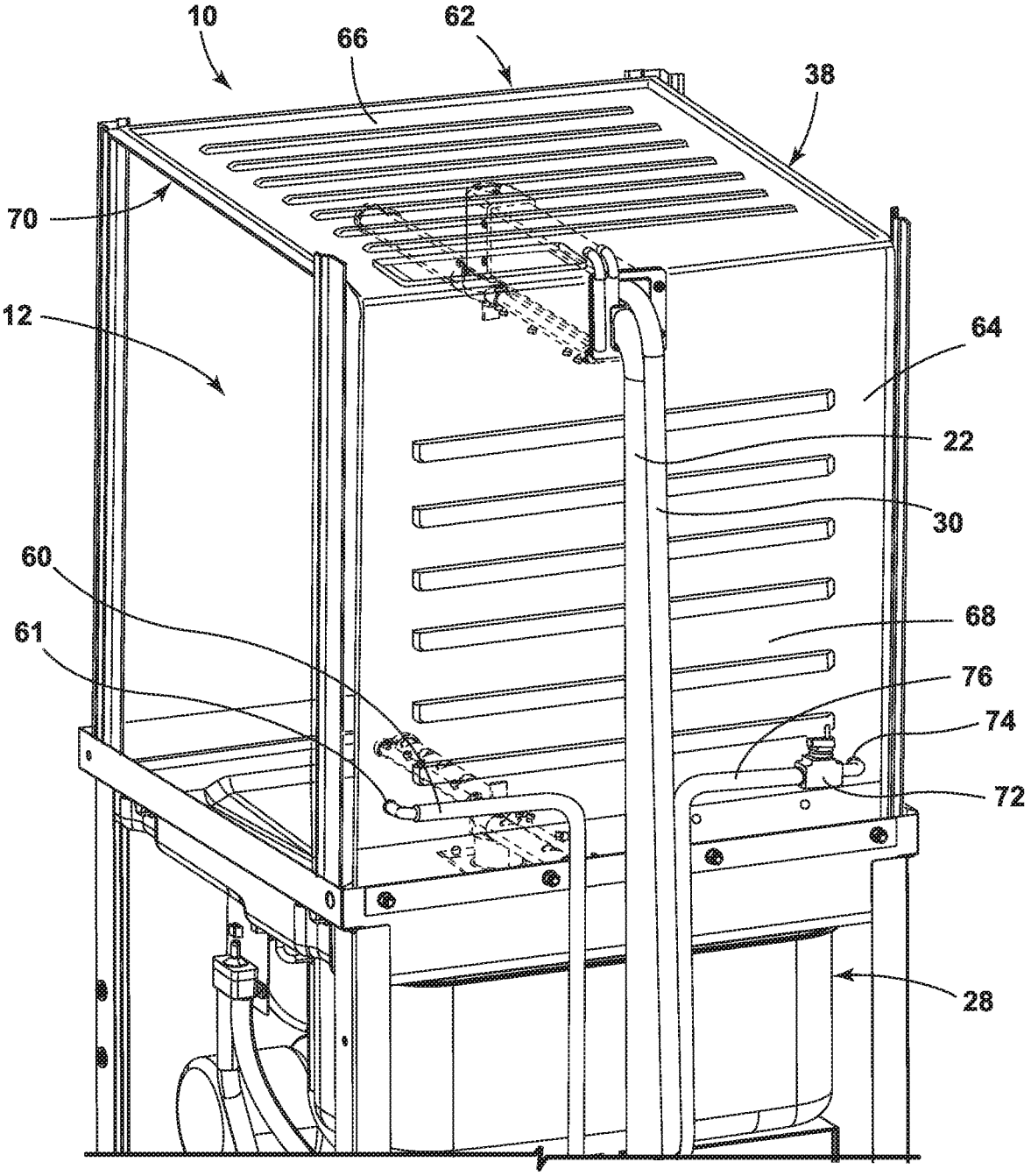
FIG. 5 is a partial rear perspective view of the dish washing machine according to an embodiment illustrating a second heat exchanger.
Figure 6:
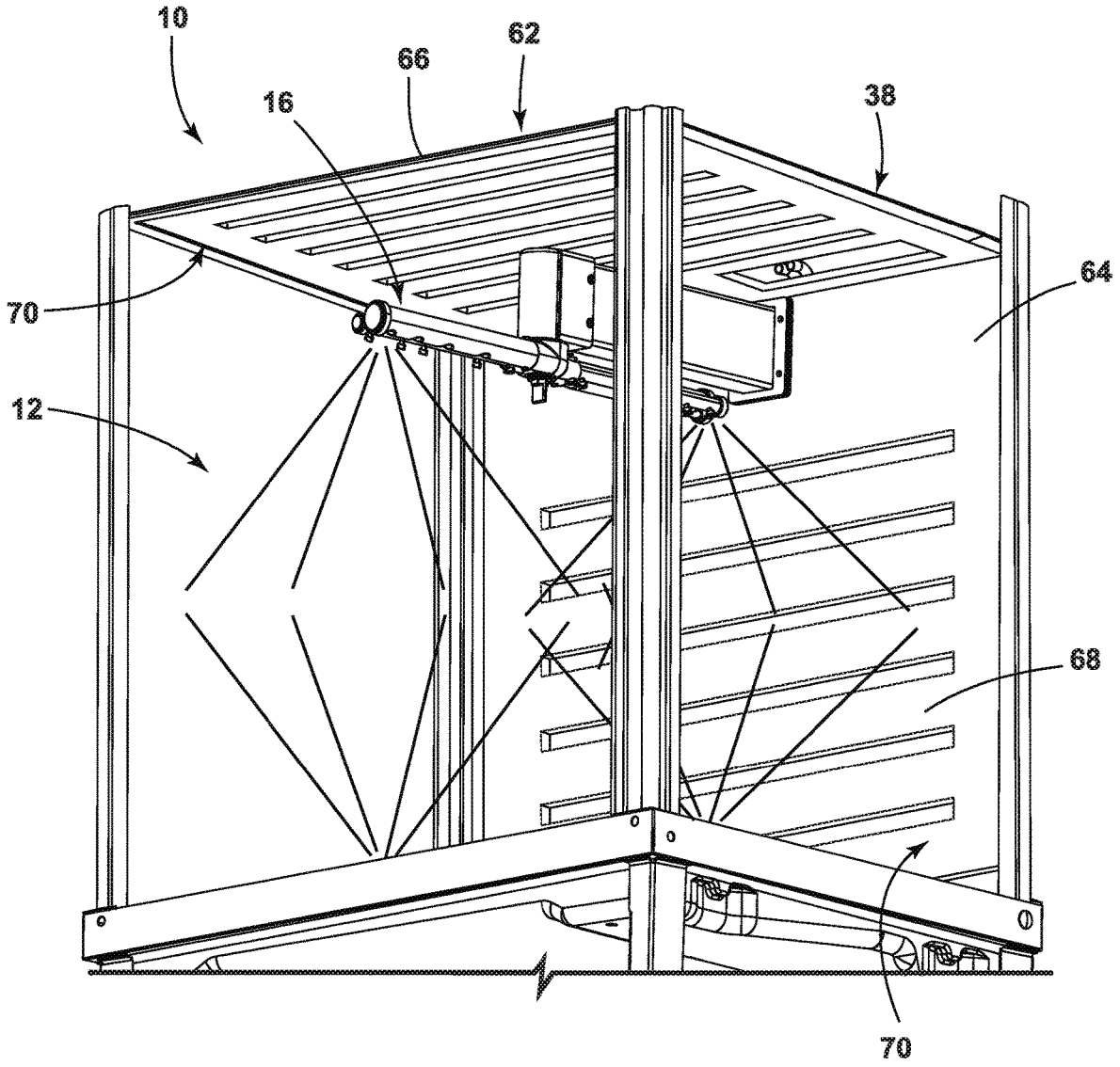
FIG. 6 is a partial front perspective view of the dish washing machine according to an embodiment illustrating fluid spray and a heat exchanger.

It is contemplated that the water can be circulated and/or retained temporarily within the cells or compartments 68 to heat the water therein. As shown in FIGS. 2 and 5, an outlet valve 72 can be located at an outlet 74 of the second heat exchange system 38 to retain the water within the second heat exchange system 38 for a desired period. After the heated water exits the second heat exchange system 38 through the outlet 74, the heated water passes through a second transfer pipe 76 to the booster heating tank 20.

Figure 7:
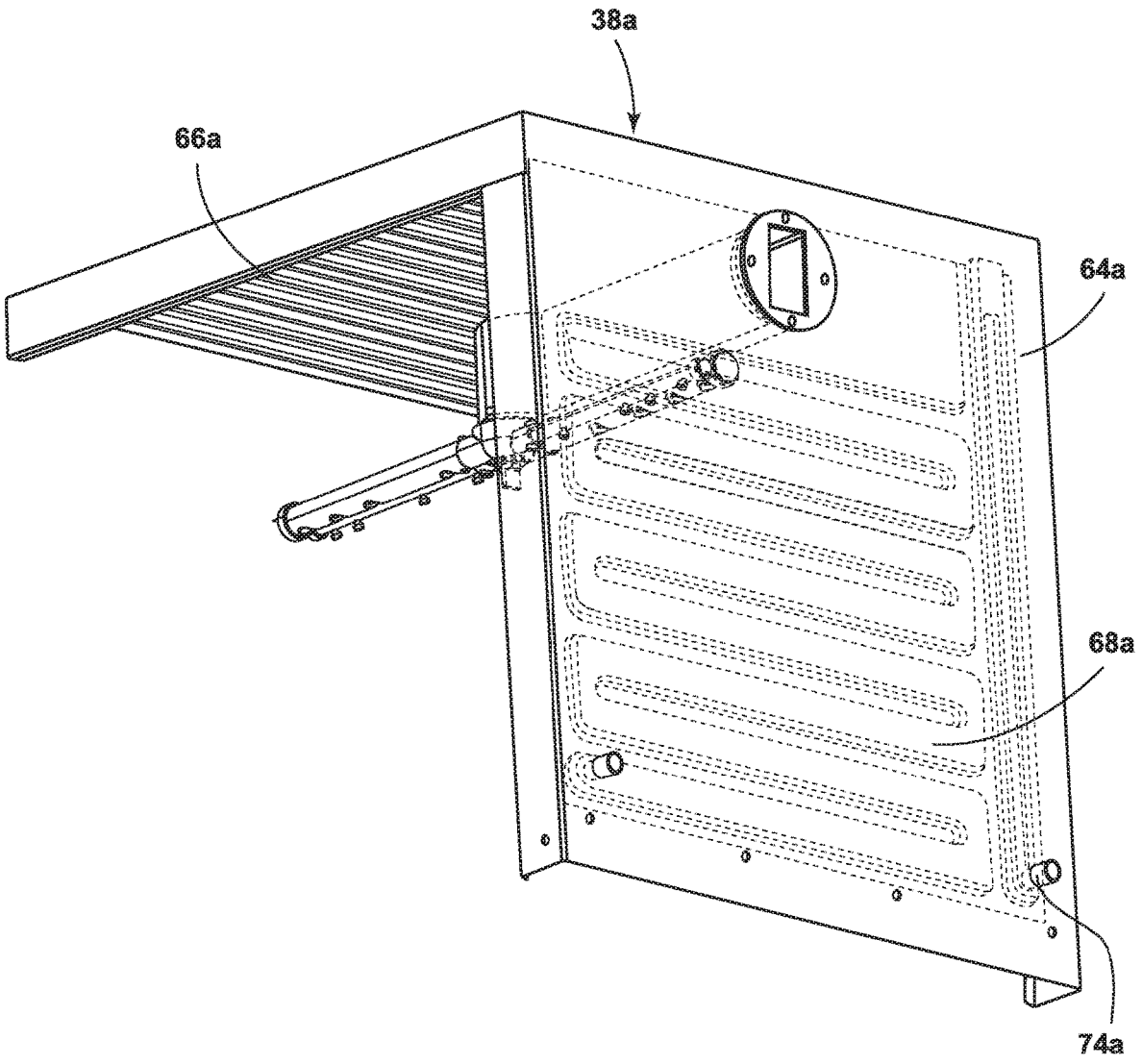
FIG. 7 is a rear perspective view of a second heat exchanger of the dish washing machine according to another embodiment.
Figure 8:
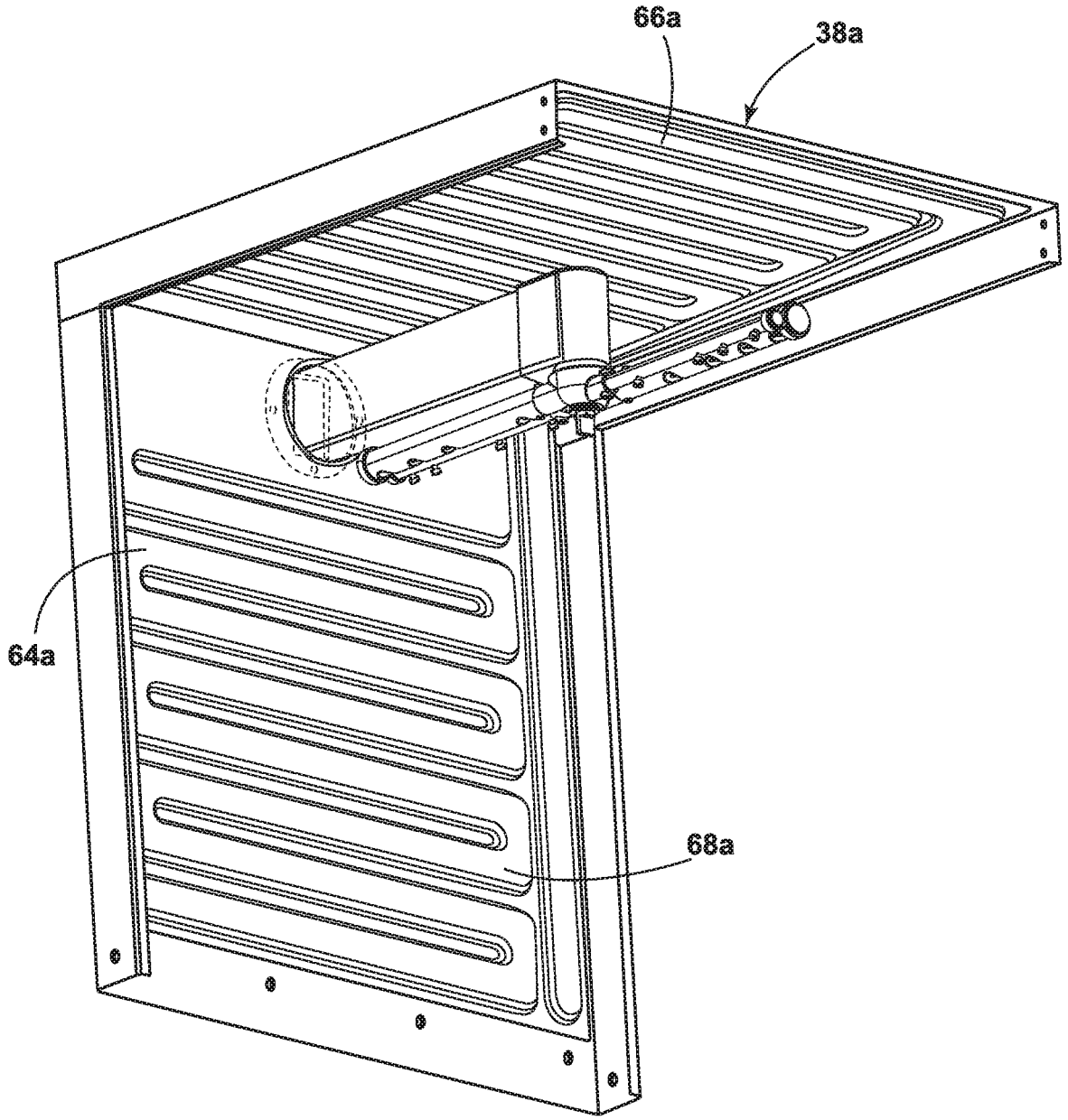
FIG. 8 is a first front perspective view of a second heat exchanger of the dish washing machine according to another embodiment.
Figure 9:
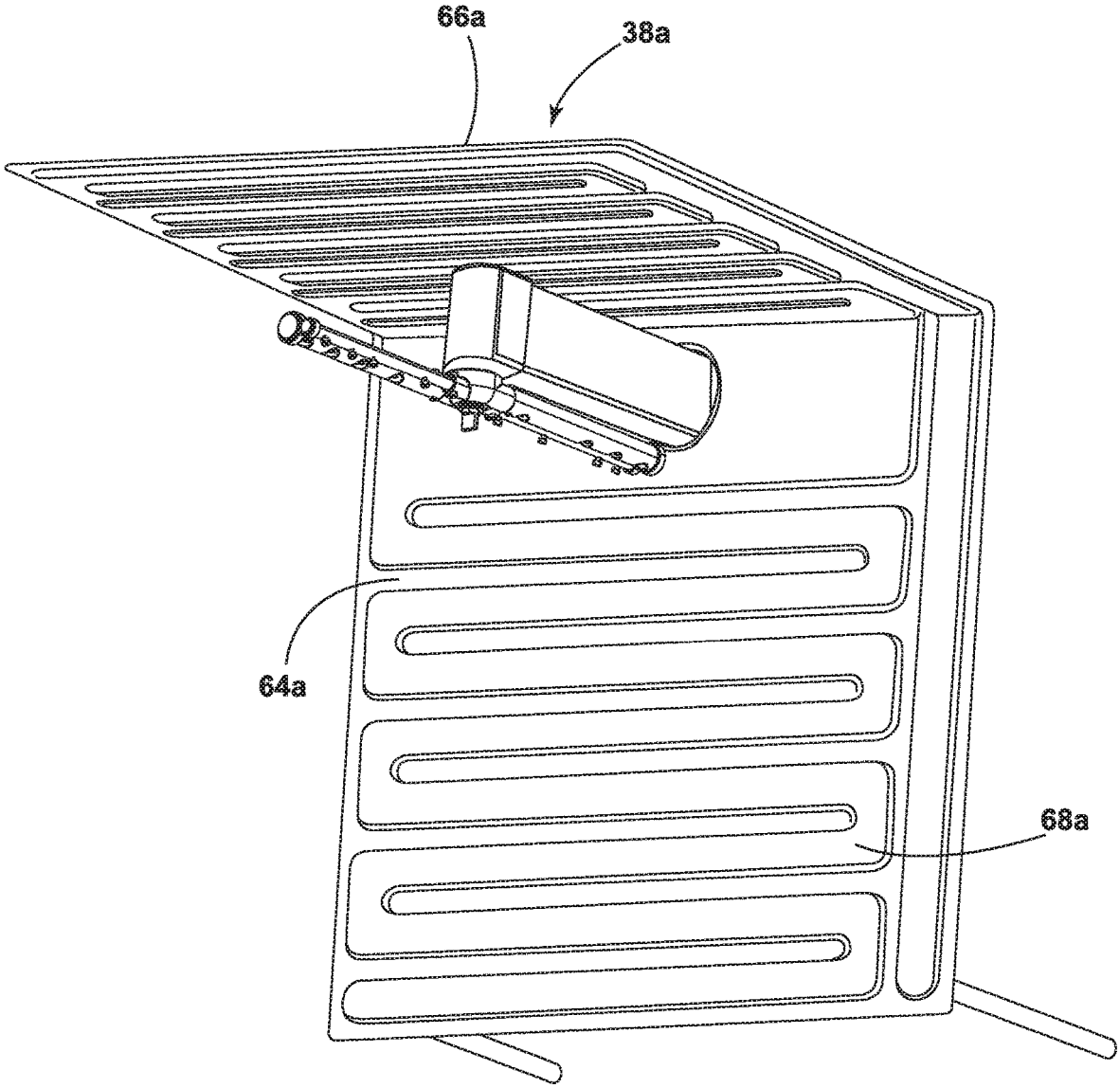
FIG. 9 is a second front perspective view of a second heat exchanger of the dish washing machine according to another embodiment.
Figure 10:
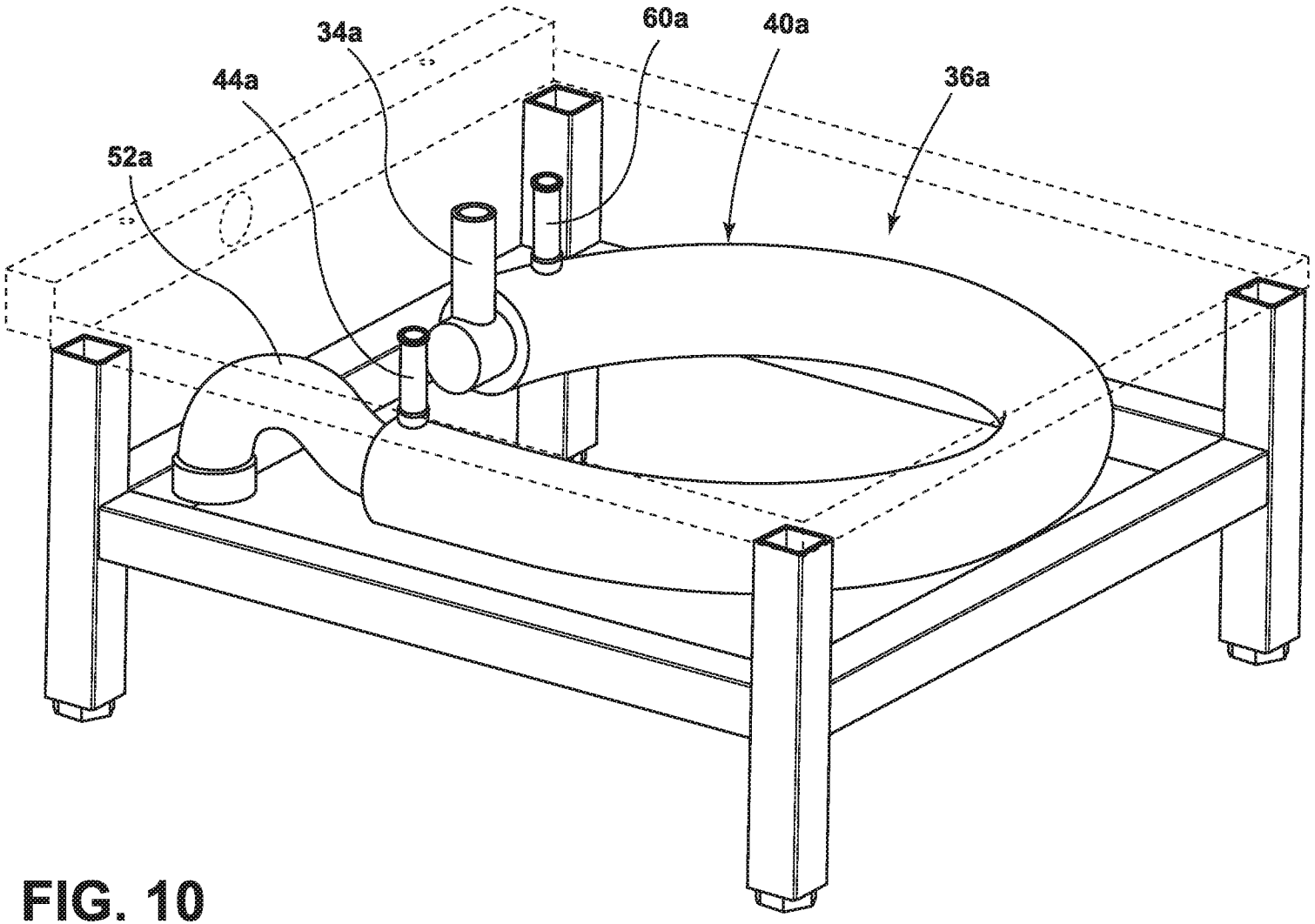
FIG. 10 is a first perspective view of a first heat exchanger of the dish washing machine according to another embodiment.
Figure 11:
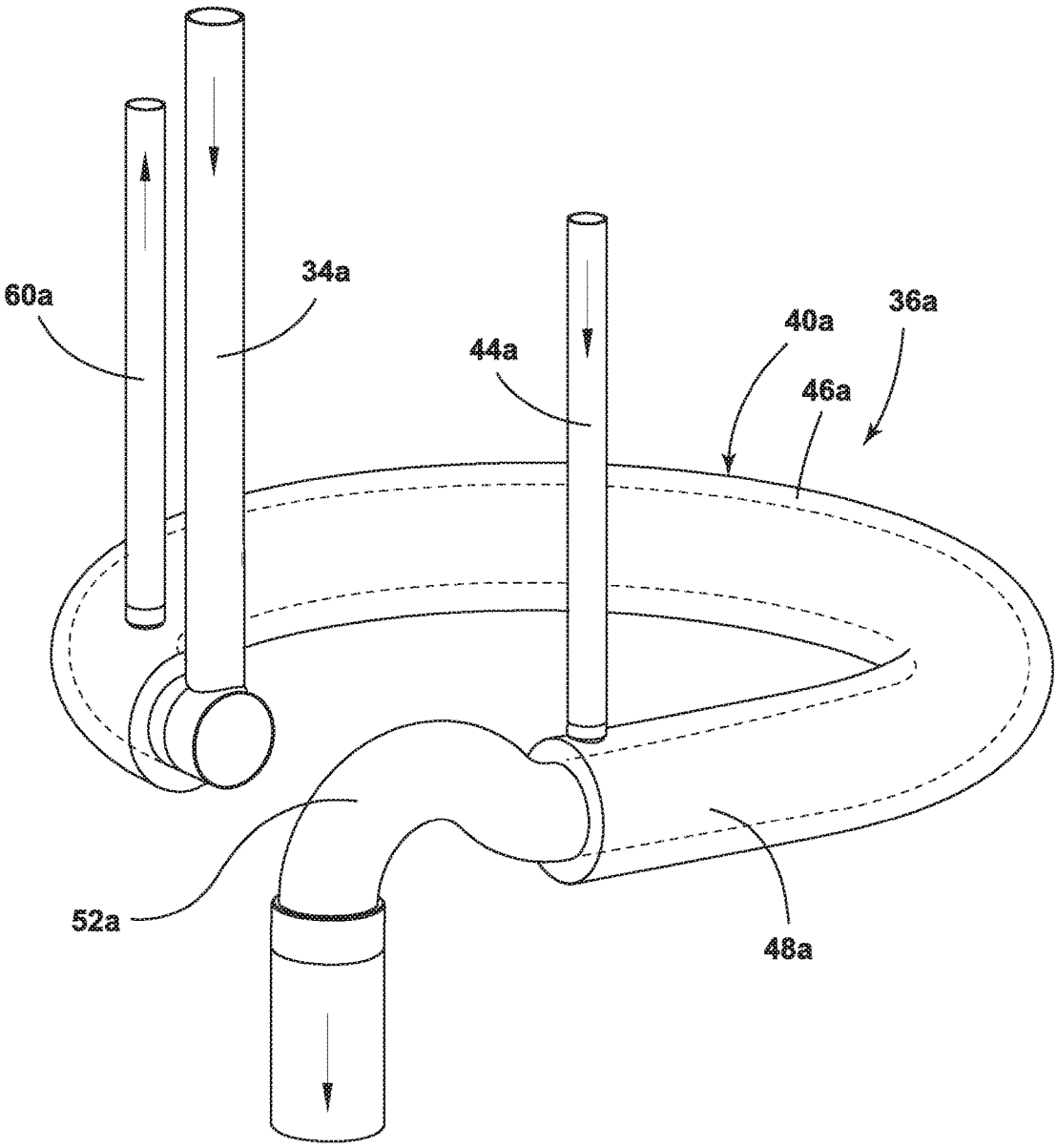
FIG. 11 is a second perspective view of the first heat exchanger of the dish washing machine according to the another embodiment.
Figure 12:
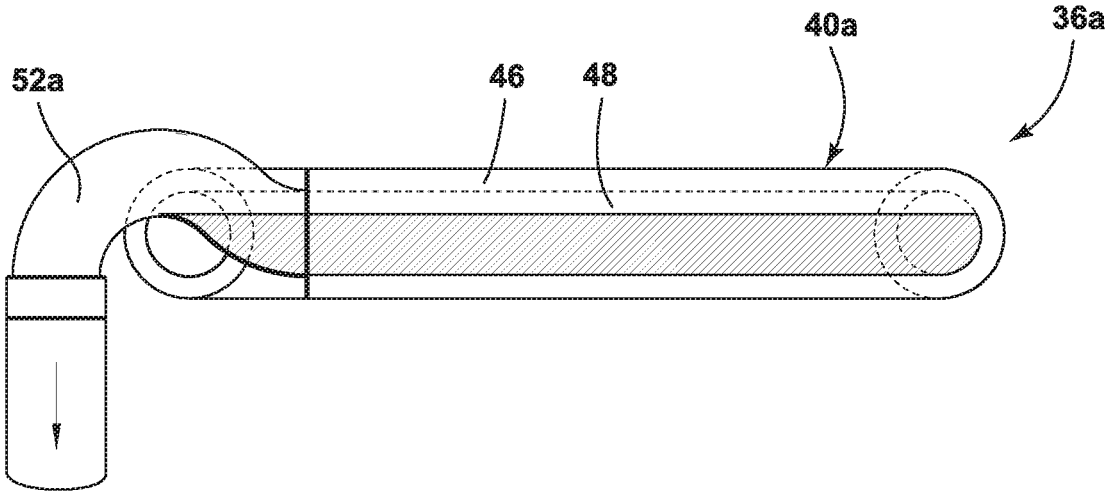
FIG. 12 is a side view of the first heat exchanger of the dish washing machine according to the another embodiment.
Figure 13:
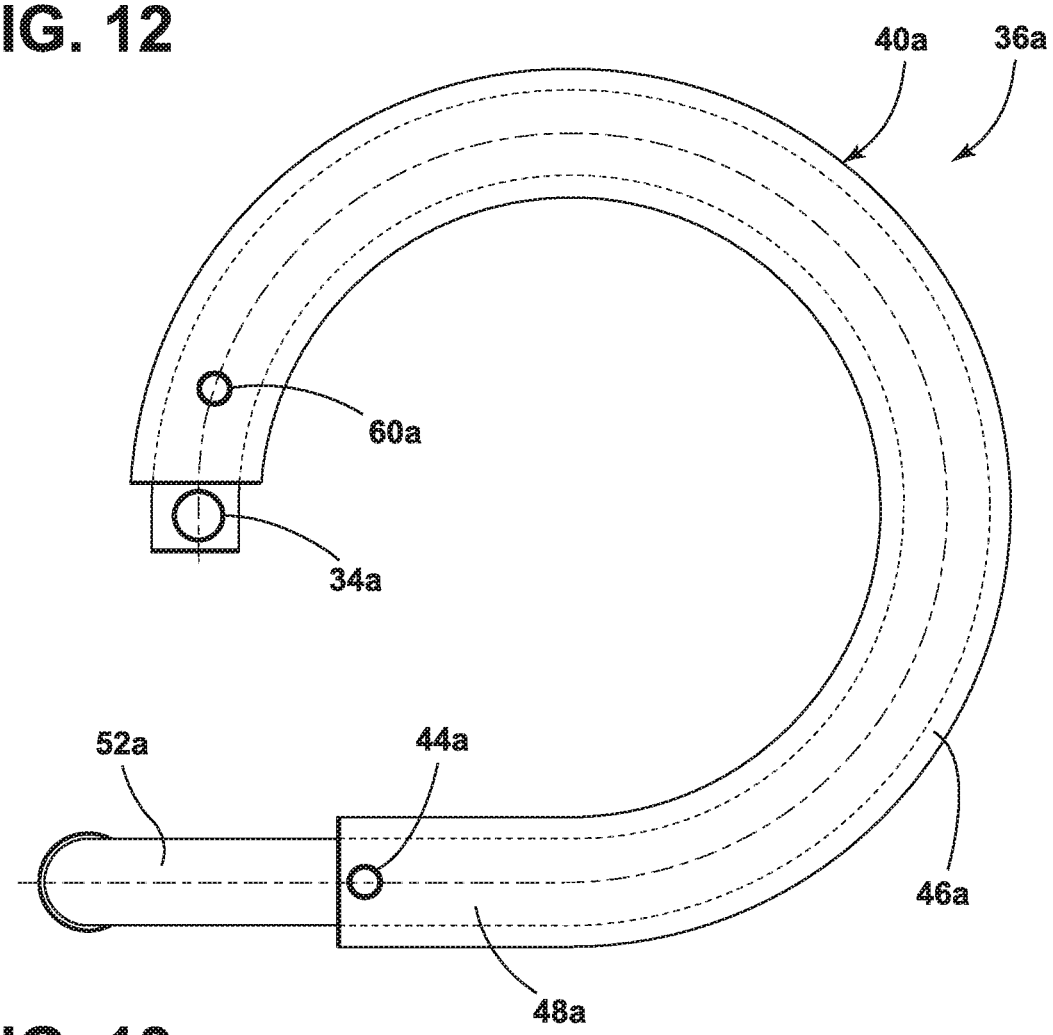
FIG. 13 is a top view of the first heat exchanger of the dish washing machine according to the another embodiment.

The reference numeral 38*a* (FIGS. 7-9) generally designates another embodiment of the present invention, having a second embodiment for the second heat exchange system. Since the second embodiment of the second heat exchange system 38*a* is similar to the previously described second heat exchange system 38, similar parts appearing in FIGS. 1-6 and FIGS. 7-9, respectively, are represented by the same, corresponding reference number, except for the suffix "a" in the numerals of the latter. The second embodiment of the second heat exchange system 38*a* includes the cells or compartments 68*a* that have a serpentine path through both the rear wall 64*a* and the top wall 66*a*, thereby making a single path through the second heat exchange system 38*a*. The second embodiment of the second heat exchange system 38*a* may or may not have the valve at the outlet 74*a* to allow the water to pass through the second heat exchange system 38*a* without being retained with the second heat exchange system 38*a*.

The reference numeral 36*a* (FIGS. 10-13) generally designates another embodiment of the present invention, having a second embodiment for the first heat exchange system. Since the second embodiment of the first heat exchange system 36*a* is similar to the previously described first heat exchange system 36*a*, similar parts appearing in FIGS. 1-6 and FIGS. 10-13, respectively, are represented by the same, corresponding reference number, except for the suffix "a" in the numerals of the latter. The second embodiment of the first heat exchange system 36*a* does not include the flow control device 50 and the bypass pipe 52*a* maintains water within the heat exchange pipe 40*a* as outlined above.

The dish washing machine 10 include heat exchangers that allow the heat from the waste water to preheat the water entering the system, thereby saving energy and also releasing cooler water to the environment than would happen without the heat exchanger. It is contemplated that the system might not have a booster heating tank and that the water heated in the first and/or second could first be sprayed though the sprayers and then heated in the wash tank before washing and subsequent rinsing.

Although particular preferred embodiments of the invention have been disclosed in detail for illustrative purposes, it will be recognized that variations or modifications of the disclosed apparatus, including the rearrangement of parts, lie within the scope of the present invention. For example, it is contemplated that only a single rotating spray arm (upper or lower) could be used.

What is claimed is:

1. A dish washing machine comprising:

a housing having an interior wash space for washing dishes, the housing having a liquid inlet for adding a liquid to the dish washing machine and a liquid outlet for removing dirty liquid from the dish washing machine;

at least one spray nozzle for spraying the liquid onto dishes positioned within the interior wash space;

a heating tank for heating the liquid which is supplied to the at least one spray nozzle for spraying onto the dishes in the interior wash space;

at least one heat exchange system within the housing, the at least one heat exchange system transferring heat from the liquid heated by the heating tank to the liquid added to the dish washing machine from the liquid inlet;

the at least one heat exchange system includes a first heat exchange system comprising a pipe having a first path therethrough and a second path therethrough;

the first path being located between the liquid inlet and the heating tank;

the second path being located between a drain for the interior wash space and the liquid outlet of the housing;

the at least one heat exchange system further comprising a second heat exchange system; and the housing including at least one wall surrounding the interior wash space;

the second heat exchange system including a fluid path adjacent the at least one wall;

the liquid in the fluid path of the second heat exchange system exchanging heat through the at least one wall surrounding the interior wash space with the liquid sprayed from the at least one spray nozzle.

2. The dish washing machine of claim 1, wherein:

the first path and the second path have the same center of flow axis.

3. The dish washing machine of claim 1, wherein:

the first path surrounds the second path.

4. The dish washing machine of claim 1, further including:

a wash tank within the housing for receiving the liquid from the heating tank and supplying the liquid to the at least one spray nozzle.

5. The dish washing machine of claim 1, wherein:

the at least one spray nozzle is a plurality of spray nozzles located on a top rotating arm and a bottom rotating arm.

6. The dish washing machine of claim 1, wherein:

the liquid entering the dish washing machine passes sequentially from the liquid inlet, then to the first heat exchange system, then to the second heat exchange system and then to the heating tank.

7. The dish washing machine of claim 1, wherein:

the first path is located between the liquid inlet and the second heat exchange system.

8. The dish washing machine of claim 1, wherein:

the at least one wall includes a top wall and a rear wall.

9. The dish washing machine of claim 1, wherein:

the fluid path is through the at least one wall.

10. The dish washing machine of claim 1, further including:

a bypass line located between the second path and the liquid outlet, the bypass line being located at a bypass height higher than a second path height of the second path, the bypass line maintaining liquid in the second path by a force of gravity.

11. The dish washing machine of claim 10, further including:

a flow control for selectively maintaining liquid in the second path or allowing the liquid to flow to the liquid outlet, the bypass line bypassing the flow control, the flow control, when opened, allowing the liquid to flow to the liquid outlet without first passing through the bypass line.

12. A dish washing machine comprising:

a housing having an interior wash space for washing dishes, the housing having a liquid inlet for adding a liquid to the dish washing machine and a liquid outlet for removing dirty liquid from the dish washing machine;

at least one spray nozzle for spraying the liquid onto dishes positioned within the interior wash space;

a heating tank for heating the liquid which is supplied to the at least one spray nozzle for spraying onto the dishes in the interior wash space;

at least one heat exchange system within the housing, the at least one heat exchange system transferring heat from the liquid heated by the heating tank to the liquid added to the dish washing machine from the liquid inlet;

the at least one heat exchange system includes a first heat exchange system comprising a pipe having a first path therethrough and a second path therethrough;

the first path being located between the liquid inlet and the heating tank;

the second path being located between a drain for the interior wash space and the liquid outlet of the housing; and a bypass line located between the second path and the liquid outlet of the housing, the bypass line being located at a bypass height higher than a second path height of the second path, the bypass line maintaining liquid in the second path by a force of gravity.

13. The dish washing machine of claim 12, wherein:

the at least one heat exchange system further comprises a second heat exchange system.

14. The dish washing machine of claim 13, wherein:

the housing includes at least one wall surrounding the interior wash space;

the second heat exchange system includes a fluid path adjacent the at least one wall;

the liquid in the fluid path of the second heat exchange system exchanges heat through the at least one wall surrounding the interior wash space with the liquid sprayed from the at least one spray nozzle.

15. The dish washing machine of claim 12, further including:

a flow control for selectively maintaining liquid in the second path or allowing the liquid to flow to the liquid outlet of the housing, the bypass line bypassing the flow control, the flow control, when opened, allowing the liquid to flow to the liquid outlet without first passing through the bypass line.

16. The dish washing machine of claim 12, further including:

a wash tank within the housing for receiving the liquid from the heating tank and supplying the liquid to the at least one rotating spray nozzle.

17. The dish washing machine of claim 12, wherein:

the at least one rotating spray nozzle is a plurality of spray nozzles located on a top rotating arm and a bottom rotating arm.

18. The dish washing machine of claim 12, wherein:

wherein the first path and the second path have the same center of flow axis.

19. The dish washing machine of claim 18, wherein:

the first path surrounds the second path.

* * * * *